US005168278A

United States Patent [19]

Morita

[11] Patent Number: 5,168,278

[45] Date of Patent: Dec. 1, 1992

[54] ANTENNA DEVICE FOR ELECTRONIC DEVICES

[75] Inventor: Yutaka Morita, Kashiba, Japan

[73] Assignee: Sanyo Electric Co., Ltd., Moriguchi, Japan

[21] Appl. No.: 852,967

[22] Filed: Mar. 17, 1992

[30] Foreign Application Priority Data

Mar. 19, 1991 [JP] Japan ..... 3-16297[U]

[51] Int. Cl.[5] ..... H01Q 1/24

[52] U.S. Cl. ..... 343/702; 343/900

[58] Field of Search ..... 343/702, 715, 900, 901, 343/903, 895, 889

[56] References Cited

U.S. PATENT DOCUMENTS 2,894,260 7/1959 Ellis ..... 343/901

4,725,845 2/1988 Phillips ..... 343/895

FOREIGN PATENT DOCUMENTS 660913 11/1951 United Kingdom ..... 343/900

*Primary Examiner*—Rolf Hille

*Assistant Examiner*—Hoanganh Le

*Attorney, Agent, or Firm*—Armstrong & Kubovcik

[57] ABSTRACT

An antenna device having a straight shaft extending from a mount member to be attached to an electronic device, and a cylinder member which comprises an antenna member and slidably fitted around the shaft in intimate contact therewith to define a generally airtight chamber by the outer end of the shaft and the inner surface of the cylinder member. The cylinder member is projectable outward along with the antenna member by an urging force when released from a lock member, the cylinder member being so projectable at a reduced speed by giving a negative pressure to the chamber.

7 Claims, 5 Drawing Sheets

ANTENNA DEVICE FOR ELECTRONIC DEVICES

FIELD OF INDUSTRIAL APPLICATION

The present invention relates to an antenna device for electronic devices such as cordless telephones and portable telephones.

BACKGROUND OF THE INVENTION

The antenna of the cordless telephone, portable telephone or like electronic device is usually fixed to an upper portion of the case of the device and extends outward, so that the projecting antenna becomes an obstacle, rendering the device difficult to handle when the device is carried about or placed on a charger for charging a rechargeable battery within the device.

To overcome this problem, an antenna has been proposed which is retractable into an electronic device as schematically shown in FIG. 4 (Unexamined Japanese Patent Publication No. 7450/1991).

The proposed antenna comprises an antenna member 60 insertable into the case 11 of the device, and means 46 for urging the antenna member, as inserted in the case, in a direction to project from the case. A lock mechanism 50 is provided for locking the antenna member 60 as inserted in the case against the urging means. The antenna member projects from the case under the action of the urging means 46 when released from locking engagement with the lock mechanism by depressing a button 54. Unexamined Japanese Utility Model Publication No. 17140/74 also discloses a device of similar construction.

When unlocked, the antenna of the prior art is forced to project from the case by being urged by the urging means, so that the antenna is likely to injure the eye or other part of the user or to break or damage an article in the neighborhood.

SUMMARY OF THE INVENTION

In an antenna device having an antenna retractable into the case of an electronic device, an object of the present invention is to render the antenna projectable with improved safety by making the antenna projectable gradually at a reduced speed when it is allowed to extend outward from the case upon unlocking.

The present invention provides an antenna device which comprises a straight shaft extending from a mount member to be attached to an electronic device, and a cylinder member having an antenna member and slidably fitted around the shaft in intimate contact therewith to define a generally airtight chamber by the outer end of the shaft and the inner surface of the cylinder member, the cylinder member being projectable outward along with the antenna member by an urging force when released from a lock member, the cylinder member being so projectable at a reduced speed by giving a negative pressure to the chamber defined by the cylinder member and the shaft end.

DESCRIPTION OF THE PREFERRED EMBODIMENT

Although some of the drawings show an antenna device of the invention as attached to a cordless telephone as an example of electronic device, the invention can of course be embodied as antennas for portable radios, television receivers and wireless devices.

Figure 1:
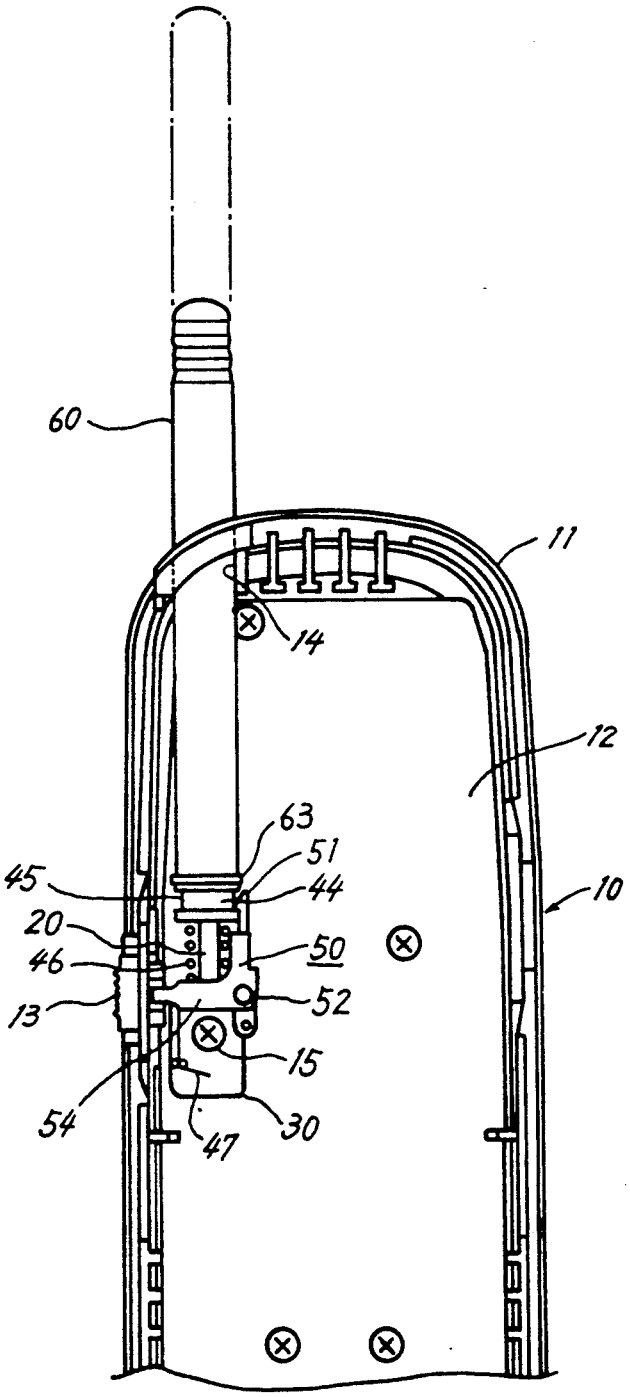
FIG. 1 is a front view of an antenna device as attached to an electronic device with the cover of the latter device removed.
Figure 5A:
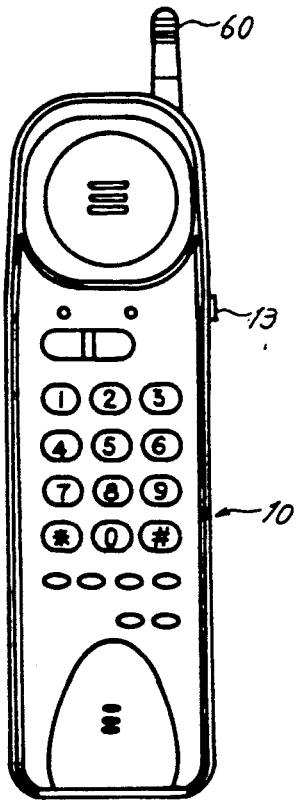
FIGS. 5, A, B and C are rear views and a side elevation showing a cordless telephone having the antenna device of the present invention.
Figure 5B:
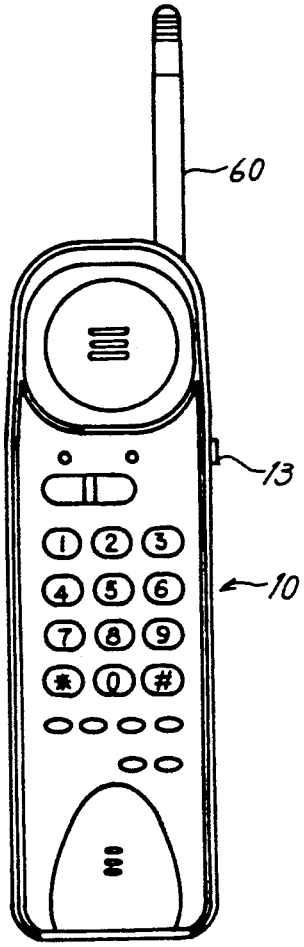
Figure 5C:
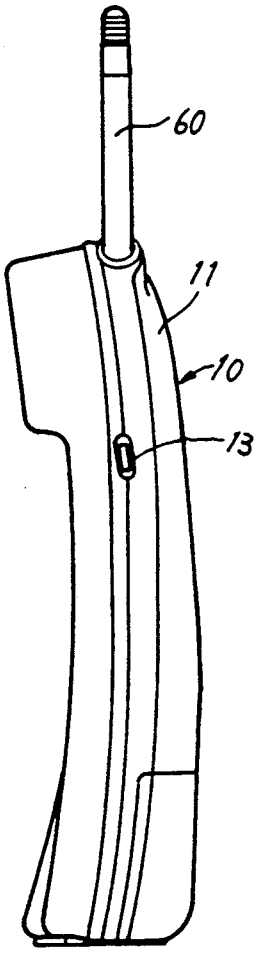

The illustrated electronic device 10 has a case 11, on a portion of which an antenna member 60 is retractably mounted. When the electronic device is to be used, the antenna member 60 is caused to project from the case 11 by manipulating a knob 13 on one side of the case as seen in FIGS. 5, B and C. When the electronic device is not used, the antenna member 60 is pushed down, thereby retracted into the case 11 as shown in FIG. 1 and FIG. 5A, and held in the retracted position.

Figure 2:
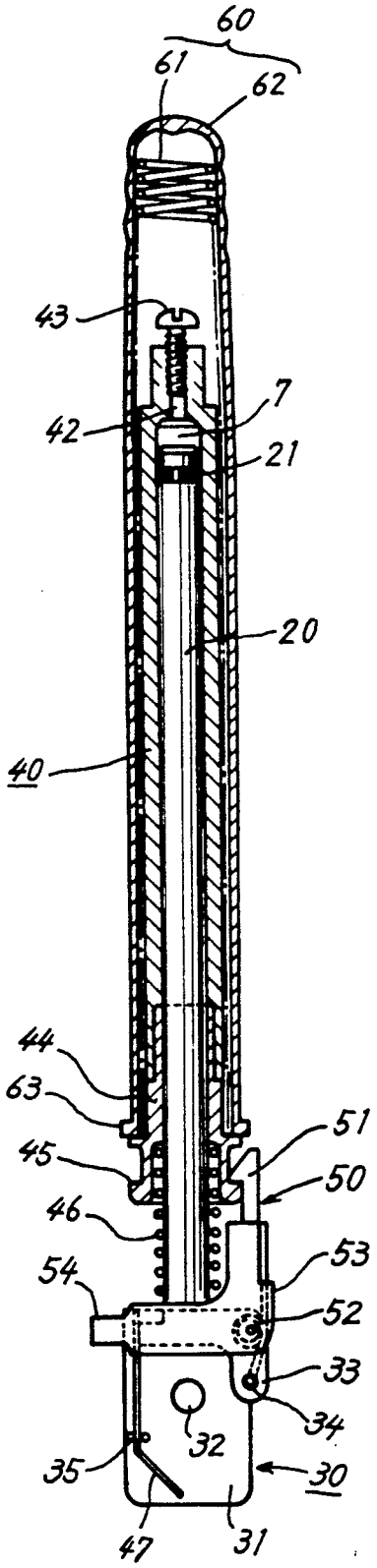
FIG. 2 is a sectional view of the antenna device.
Figure 3:
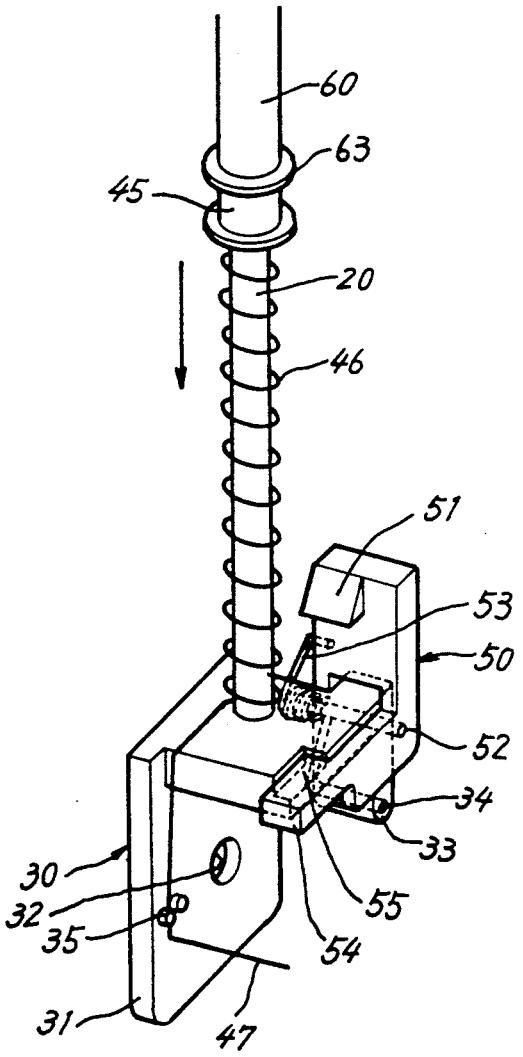
FIG. 3 is a perspective view of a mount member.
Figure 4:
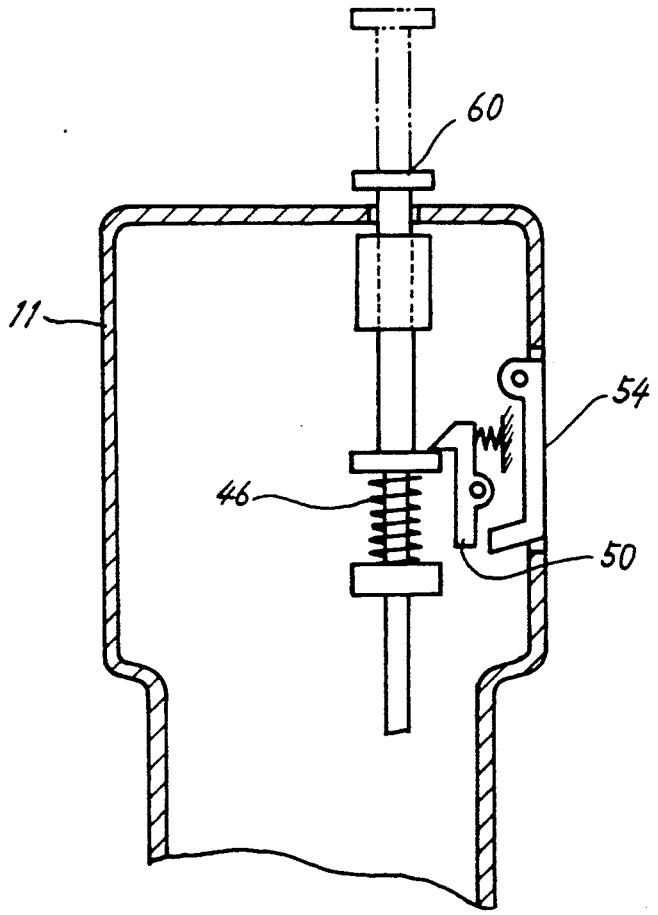
FIG. 4 PRIOR ART
FIG. 4 is a sectional view of a conventional antenna device.

With reference to FIG. 2, the antenna member 60 comprises a helically wound antenna coil 61 covered with a cover member 62 of plastic material. The antenna member 60 is fitted over and adhered to a tubular cylinder member 40 made of an insulating material. A base end portion 44 made of an electrically conductive material is adhered to the tubular lower end of the cylinder member 40. The base end portion 44 has at its lower end an engageable portion 45 in the form of an outwardly projecting flange.

A straight shaft member 20 made of an insulating material is slidably inserted in the hollow bore inside the cylinder member 40. A compression spring 46 is provided between the base end portion 44 of the cylinder member 40 and a mount member 30 which is integral with, or fixedly connected to, one end of the shaft member 20. The cylinder member 40 is urged upward by the spring 46.

The shaft member 20 and the cylinder member 40, which are slidable relative to each other, are substantially hermetically fitted together in intimate contact with each other. An 0-ring 21 is provided at an outer end portion of the shaft member 20, and silicone oil or like viscous or tacky material is applied to the surface of the shaft member 20, whereby the clearance between the shaft member 20 and the cylinder member 40 is sealed off hermetically. The upper end of the cylinder member 40 is formed with an air inlet port 42 having an adjusting screw 43 screwed therein. A generally airtight chamber 7 is defined by the outer end of the shaft member 20 and the bore-defining inner surface of the cylinder member 40. The air inlet port 42 or the adjusting screw 43 is tapered, such that the amount of flow of air through the clearance in the port 42 around the screw 43 is adjustable by advancing the screw 43 in screw-thread engagement with the cylinder member 40. When the cylinder member 40 moves away from the shaft member 20, a negative internal pressure is produced in the chamber 7, whereas the negative pressure is reduced by a flow of air into the chamber through the minute clearance in the inlet port 42 around the thread of the adjusting screw 43.

The negative pressure of the airtight chamber 7 is adjusted by moving the adjusting screw 43 and by the silicone oil or like tacky material to be applied to the surface of the shaft member 20.

The mount member 30 integral with the base end of the shaft member 20 is provided with a lock member 50 to be opposed to the engageable portion 45 of the cylinder member 40 as located in a lowered position when the antenna member 60 is pushed down.

The lock member 50 is L-shaped and has a base end rotatably supported by a pivot 52 on the mount member 30, a hook 51 provided on a free end thereof and having a slanting upper face, and a stopper 55 extending from another free end thereof. A spring 53 is provided between the lock member 50 and the mount member 30. One end of the spring 53 bears on the lock member 50, and the other end thereof is engaged in a retaining bore 34 formed in a wall 33 projecting from the mount member 30, whereby the lock member 50 is urged into rotation to advance the hook 51 to a position where it is engageable with the cylinder member 40, with the stopper 55 bearing on a portion of the mount member 30 to prevent the lock member 50 from rotating inward to excess.

A knob member 54 extends from the second-mentioned free end of the lock member 50 integrally therewith. When pushed up, the knob portion 54 rotates the lock member 50, releasing the engageable portion 45 of the cylinder member 40 from the hook 51.

The mount member 30 has a mount wall 31 which is provided with a mount hole 32 and a pair of projections 35 for engaging an extension 47 of the spring 46.

The antenna device having the construction described above is assembled by the following steps.

(A) The spring 46 is provided on the shaft member 20, and the extension 47 thereof is positioned along the mount wall 31 of the mount member 30 and engaged with the projections 35 on the wall.

(B) The spring 53 and the lock member 50 are attached to the pivot 52 mounted in the projecting wall 33 integral with the mount member 30, one end of the spring 53 is engaged in the retaining bore 34 in the projecting wall 33, and the outer end of the pivot 52 is collapsed to prevent the lock member 50 from slipping off.

(C) The O-ring 21, which is made of rubber, is fitted into an annular groove formed in the outer end portion of the shaft member 20.

(D) The screw 43 serving as means for adjusting the amount of flow of air into the cylinder member 40 is screwed into the inlet port 42 formed in the upper end of the cylinder member 40, silicone oil or like tacky material is applied to the inner surface of the cylinder member 40, and the base end portion 44 is thereafter bonded to the lower end of the cylinder member 40 with adhesive.

(E) The assembly of the cylinder member 40 and the end portion 44 obtained by step (D) is fitted around the shaft member 20. The speed of movement of the cylinder member 40 is adjusted by rotating the screw 43 and thereby varying the amount of air flowing into the member 40.

(F) The cylinder member 40 is removed from the shaft member 20 after the above adjustment, and the antenna coil 61 and the cover member 62 are bonded to the outer surface of the cylinder member 40 with adhesive to complete the antenna member 60, which is then fitted to the shaft member 20.

The antenna device thus completed and embodying the invention is attached to the electronic device 10 as shown in FIG. 1.

With reference to FIG. 1, the mount member 30 of the antenna device is fixed along with a printed board 12 to a boss (not shown) inside the case 11 of the electronic device 10 with a screw 15, and the spring extension 47 is connected to an input terminal on the electric circuit (not shown) inside the device 10. The antenna member 60 is caused to project outward from the case 11 through an antenna hole 14 in the case wall. When the electronic device 10 is to be carried about, stored or charged, the antenna member 60 is pushed down and held retracted in the case 11 with a short length of the member projecting from the case.

The knob member 54 is in engagement with a knob 13 reciprocatingly movably provided on the wall of the case 11. The knob 13, when manipulated from outside, moves the knob member 54 to shift the lock member 50 therewith.

Since the cylinder member base end portion 44 and the spring 46 are made of electrically conductive material, electric signals received by the antenna coil 61 are fed to the circuit of the electronic device 10 via the cylinder member base end portion 44, the spring 46 and the spring extension 47.

When the knob portion 54 is moved by manipulating the knob 13 to use the electronic device, the lock member 50 shifts with this movement, bringing the hook 51 out of engagement with the engageable portion 45 of the cylinder member 40, whereupon the cylinder member 40 is pushed up along the shaft member 20 by being urged by the spring 46. However, since a negative pressure is produced in the airtight chamber 7 between the member 40 and the outer end of the shaft member 20, the member 40 moves up slowly at a reduced speed in accordance with the amount of air flowing into the chamber 7. At a limit position of rise of the antenna member 60, a flange 63 formed at the lower- end of the cover member 62 comes into contact with the edge of the case wall defining the antenna hole 14, whereby the member 60 is prevented from projecting.

The antenna device is retracted into the case 11 by depressing the outer end of the antenna member 60. The air in the chamber 7 is thereby depressed and discharged from the chamber through the clearance in the air inlet port 42 around the adjusting screw 43. At a lowered limit position of the member 60, the engageable portion 45 of the cylinder member base end portion 44 moves down over the hook 51 of the lock member 50 to therebelow and is spontaneously locked.

According to the present invention, the antenna member 60, when unlocked by a shift of the knob member 54, is forced upward by the spring 46, with an increasing negative pressure produced in the airtight chamber 7, so that the antenna device can be projected at a reduced speed. This ensures safety, eliminating the likelihood that if projected abruptly, the antenna device will injure the eye of the user or cause damage to an article in the neighborhood.

The present invention is not limited to the drawings and the foregoing embodiment but can of course be modified in design without departing from the scope of the invention as defined in the appended claims.

For example, the lock member can be provided on the wall of the case of the electronic device.

Alternatively, the lock member 50 and the knob member 54 may be provided as separate members for the knob member 54 to shift the lock member 50 in operative relation therewith.

What is claimed is:

1. An antenna device retractably mounted on a case for an electronic device, the antenna device being characterized in that the device comprises:

a mount member attachable to a wall of the case of the electronic device, a shaft member projecting from the mount member and extending straight toward a direction in which the antenna device is to be projected;

a cylinder member slidably fitted around the shaft member in intimate contact therewith to form a generally airtight chamber between an outer end of the shaft member and the cylinder member and urged outward by a spring provided between the mount member and the cylinder member, a lock member disposed as opposed to the cylinder member in a position retracted into the case and having an engaging portion releasably engageable with the cylinder member in the retracted position, a knob member coupled to the lock member for forcibly moving the engaging portion out of engagement with the cylinder member, and an antenna member provided over the cylinder member, the cylinder member being projectable at a reduced speed under the urging action of the spring by giving a negative pressure to the changer between the cylinder member and the outer end of the shaft member.

2. An antenna device as defined in claim 1 wherein the cylinder member has an outer end provided with adjusting means for permitting air to flow thereinto.

3. An antenna device as defined in claim 1 wherein the lock member is provided on the mount member.

4. An antenna device as defined in claim 3 wherein the knob member is integral with the lock member.

5. An antenna device as defined in claim 1 wherein a base end portion of the cylinder member and the spring are made of an electrically conductive material, and the antenna member comprises a helically wound tubular antenna coil, the antenna coil having one end in conduction with the base end portion of the cylinder member, the base end portion being connected by the spring to an electric circuit disposed inside the electronic device.

6. An antenna device as defined in claim 1 wherein a tacky material is applied to the outer surface of the shaft member.

7. An antenna device as defined in claim 1 wherein the shaft member is integral with the mount member.

* * * * *